US005722608A

United States Patent [19]

Yamazaki

[11] Patent Number: 5,722,608

[45] Date of Patent: Mar. 3, 1998

[54] CORELESS ROLL OF WEB MATERIAL

[76] Inventor: Tokushichi Yamazaki, 2-7-6, Kunikubo, Fuji-shi, Shizuoka-ken, Japan

[21] Appl. No.: 786,193

[22] Filed: Jan. 17, 1997

Related U.S. Application Data

[63] Continuation of Ser. No. 599,671, Feb. 12, 1996, abandoned, which is a continuation of Ser. No. 126,573, Sep. 24, 1993, abandoned.

[30] Foreign Application Priority Data

Sep. 25, 1992 [JP] Japan ..... 4-279281
Jun. 23, 1993 [JP] Japan ..... 5-152231

[51] Int. Cl.[6] ..... B65H 18/28; B65H 75/08

[52] U.S. Cl. ..... 242/160.1; 242/520; 242/613.2

[58] Field of Search ..... 242/160.1, 520, 242/613.2

[56] References Cited

U.S. PATENT DOCUMENTS 1,868,115 7/1932 Milligan ..... 242/532.2
3,791,602 2/1974 Isakson ..... 242/521
4,487,378 12/1984 Kobayashi ..... 242/160.1
4,783,015 11/1988 Shimizu ..... 242/160.1

FOREIGN PATENT DOCUMENTS 2 351 901 12/1977 France .
51-55404 5/1976 Japan .
51-61049 11/1976 Japan .
1 554 619 10/1979 United Kingdom .

*Primary Examiner*—John Q. Nguyen
*Attorney, Agent, or Firm*—Brinks Hofer Gilson & Lione

[57] ABSTRACT

A coreless roll of web material is made by winding a web material around a mandrel. The mandrel has a plurality of radially extending projections at spaced intervals. The free end of the web material is then pressed against the mandrel by a pressure roller for the initial winding of a roll. Affixing binder is applied to the pressure roller, and the web material is pressed between the pressure roller and the projections of the mandrel to transfer the affixing binder from the pressure roller to at least the first two windings of the roll whereby they are releasably affixed together. The web material is wound about the mandrel to provide a fully wound roll. The roll is thereafter severed from the remainder of the web material. The mandrel is then removed from the roll to render the roll coreless.

19 Claims, 7 Drawing Sheets

CORELESS ROLL OF WEB MATERIAL

This application is a continuation of application Ser. No. 08/599,671, filed Feb. 12, 1996, abandoned, which is a continuation of application Ser. No. 08/126/573, filed Sep. 24, 1993, abandoned.

BACKGROUND OF THE INVENTION

The present invention relates to a coreless roll of web material such as paper, and a method of forming the web material into a coreless roll. The invention has particular application to toilet paper rolls and methods for forming such rolls.

A conventional roll of toilet paper typically includes a core made of cardboard. A toilet paper roll holder typically includes a pair of support bars which are inserted into the core to hold the roll in the toilet paper roll holder.

The prior art includes various forms of coreless rolls of toilet paper, such as that shown in FIG. 1. Such a coreless roll, however, tends to be collapsed when the toilet paper is almost exhausted from the roll. Referring specifically to FIG. 1, a conventional toilet paper roll holder 2 includes a rear wall 4 adapted to be secured to the wall of a bathroom, a pair of side walls 6, 6 extending forwardly from opposite sides of the rear wall 4, and a cover 8 pivotally mounted to the side walls 6, 6. A space 10 is defined by the rear wall 4 and the side walls 6, 6 to receive a coreless roll of toilet paper 12. A pair of opposite support bars 14, 14 are so biased as to normally extend horizontally from the respective side walls 6, 6 of the toilet roll holder 2. The coreless roll of toilet paper 12 has a center bore 16.

In use, the coreless roll 12 is inserted into the space 10 from below the toilet paper roll holder 2 so as to move the support bars 14, 14 from their horizontal position toward their vertical position against the bias of springs (not shown). At this time, the support bars 14, 14 are inserted into the bore 16 of the coreless roll 12. After the support bars 14, 14 have been inserted, the coreless roll 12 is lowered to return the support bars 14, 14 to their horizontal position so as to hold the coreless roll 12 in place in the toilet paper roll holder 2. When a desired length of toilet paper is withdrawn from the coreless roll 12, transverse forces act on the coreless roll 12. These forces tend to cause the coreless roll to collapse, particularly when the toilet paper is exhausted from the coreless roll 12. In such a case, the roll drops from the toilet roll holder 2.

U.S. Pat. No. 4,487,378 discloses a coreless roll of a toilet paper with a bore having a polygonal cross section. The first several windings of the toilet paper are moistened with water containing an adhesive or glue to facilitate maintaining of the shape of the bore. The moisture is applied in longitudinal stripes that extend along the length of the paper and perpendicular to the axis of the roll. As a result, those windings are adhesively attached to each other to thereby prevent the roll from collapsing under the action of transverse forces.

SUMMARY OF THE INVENTION

Accordingly, it is an object of the present invention to provide a coreless roll of web material which will not collapse under the action of transverse forces and which is able to be withdrawn until it is completely exhausted.

Another object of the present invention is to provide a method of forming a web material into a roll without a core.

Accordingly, in one embodiment of the present invention, there is provided a coreless roll of web material comprising a number of windings with a center bore. At least the first two windings, and preferably, the first six to ten windings, adjacent to the central bore, include a plurality of circumferentially spaced-apart lines of affixing binder, such as glue. These lines of affixing means extend in a direction transversely of the web material, i.e., parallel to the axis of the roll, for releasably affixing at least the first two windings of the roll. Advantageously, the lines of affixing means resist transverse forces which act on the coreless roll when the web material is withdrawn from the roll. These lines of affixing binder are spaced from each other along the circumference of the roll to facilitate release of the first two windings and enable complete withdrawal and use of the web material.

In a preferred embodiment of the invention, the web material is toilet paper. The coreless roll has a diameter of approximately 110 mm, and the central bore has a diameter of approximately 30 to 35 mm. The affixing means includes water. Alternatively, a glue in a diluted state may be used. Other types of binder are possible and within the scope of the present invention.

According to another aspect of the present invention, there is provided a method of forming a web material into a coreless roll. The method includes the steps of feeding a web material to a substantially cylindrical mandrel with a plurality of axially extending projections arranged in a circumferentially spaced relationship. A free end of the web material is pressed against the mandrel by a pressure roller for initial winding of a roll. Affixing means or binder is applied to the pressure roller by pressing the web material between the pressure roller and the axially extending projections of the mandrel so as to transfer the affixing means from the pressure roller to at least first two windings of the roll. In this manner, at least the first two windings of the roll are affixed together. The web material is wound about the mandrel to provide a fully wound roll. The fully wound roll is then severed from the remainder of the web material. When the mandrel is removed from the fully wound roll, the roll is rendered coreless.

These and other objects of the present invention will become clear from the following detailed description of preferred embodiments when taken in conjunction with the accompanying drawings.

DESCRIPTION OF THE PREFERRED EMBODIMENTS

Figure 1:
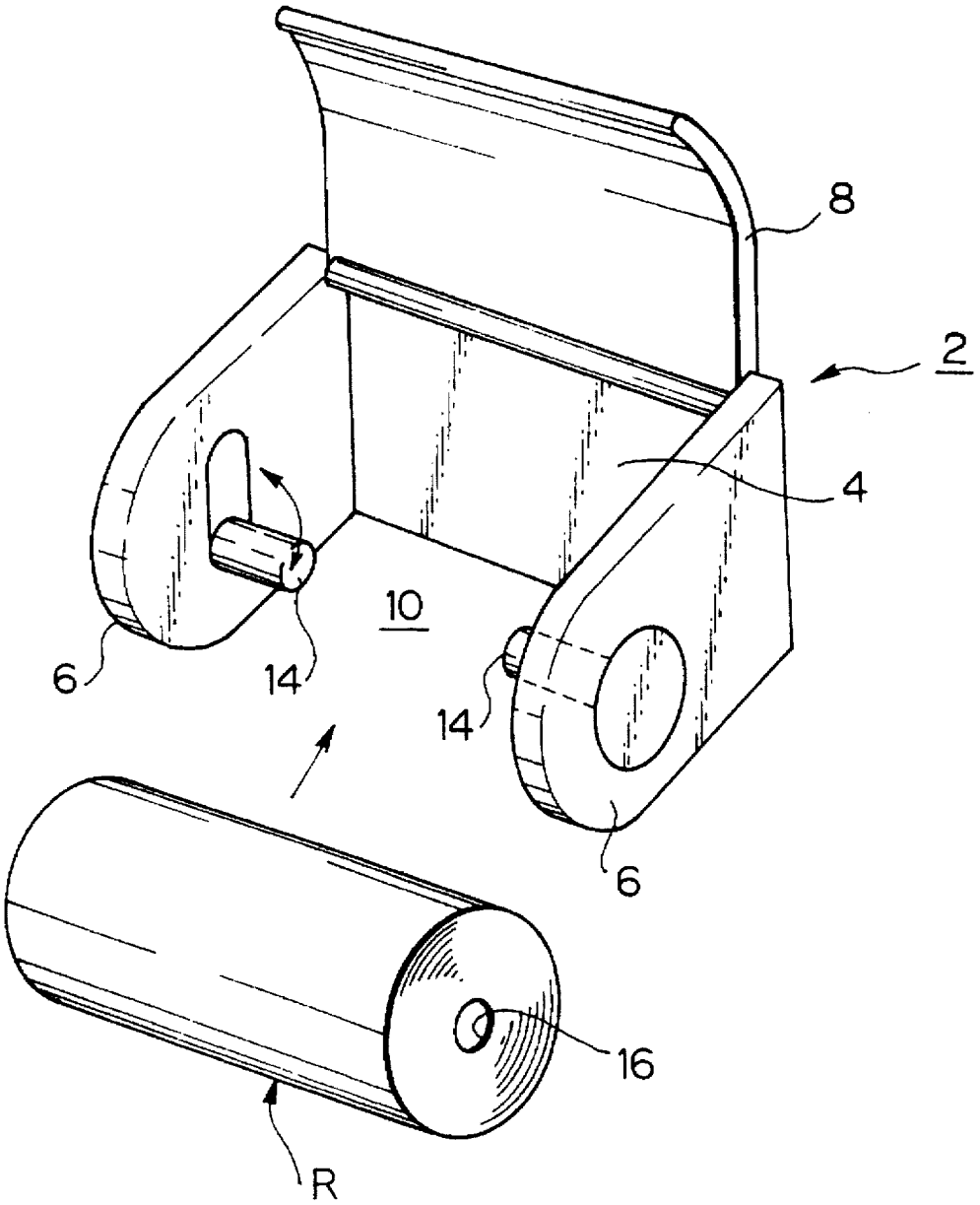
Fig. 1 PRIOR ART
FIG. 1 is a perspective view of a toilet paper roll holder and a conventional coreless roll of toilet paper.
Figure 2:
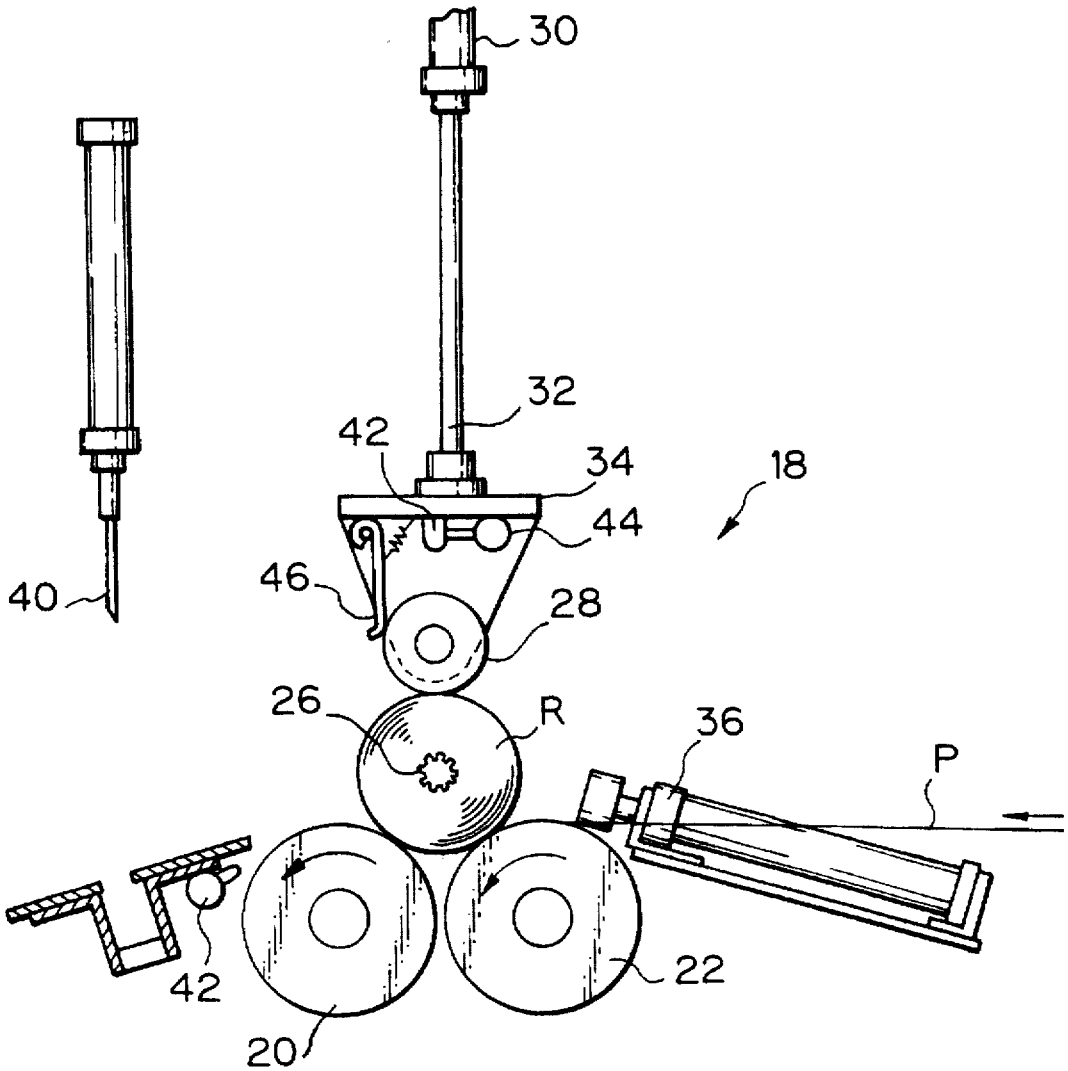
FIG. 2 is a schematic view of a winding machine, showing the manner in which a web material is wound about a mandrel.
Figure 3:
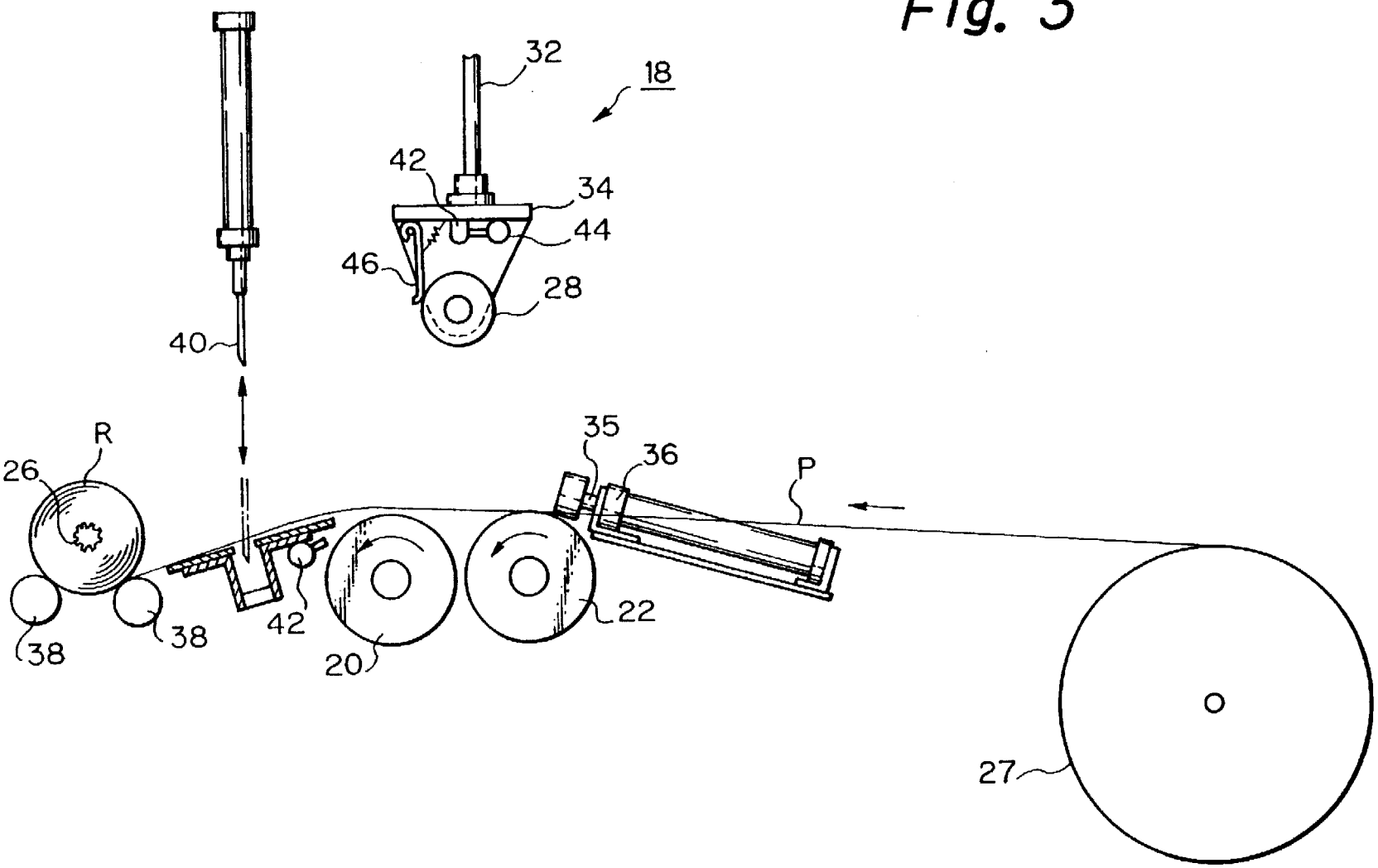
FIG. 3 is a view similar to FIG. 2, both showing the manner in which a cutter is actuated to sever a fully wound roll from the remainder of the web material.
Figure 4:
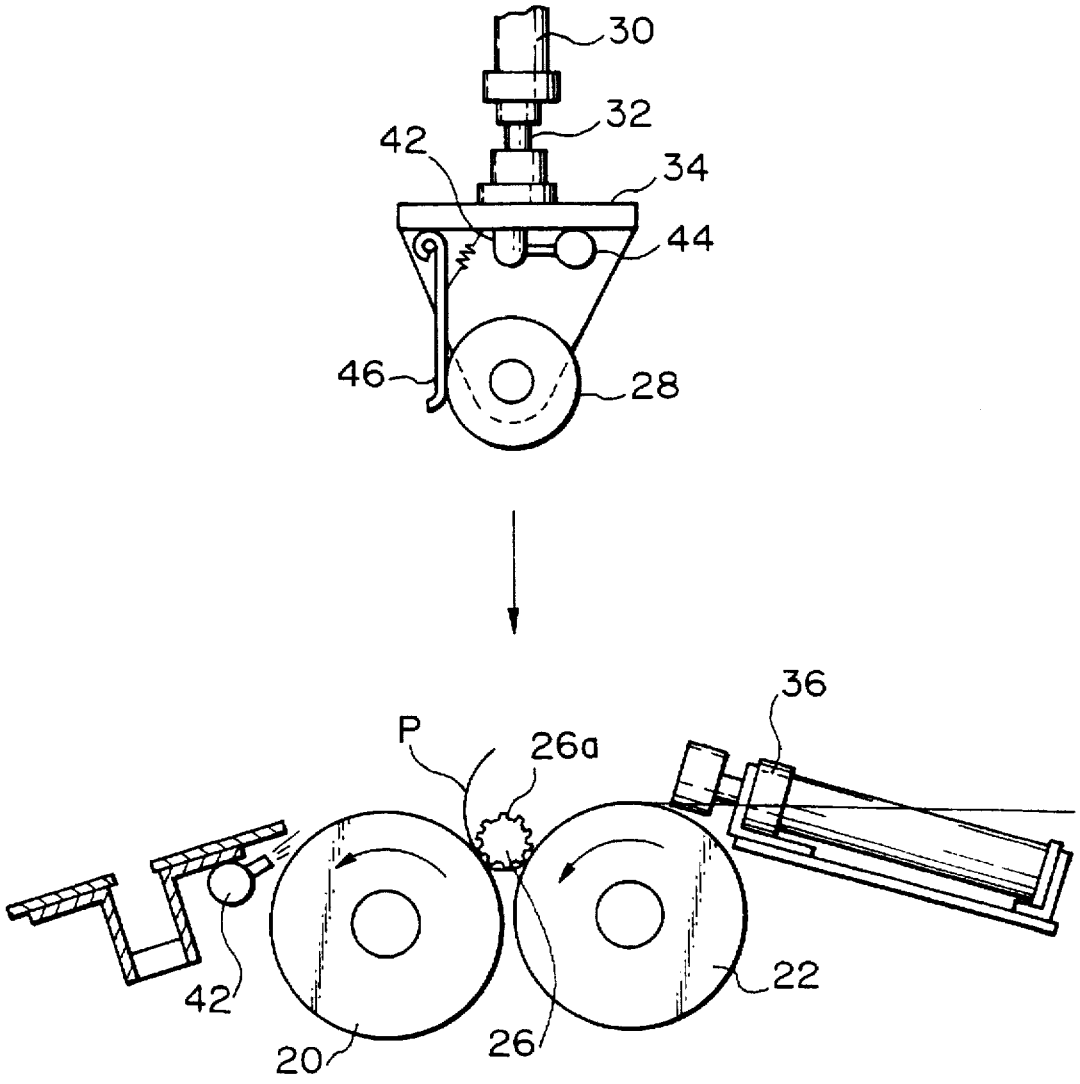
FIG. 4 is a view showing the manner in which a jet of air is directed to the free end of the web material to initiate the winding of a roll.

Referring now to the drawings, and particularly FIGS. 2 to 4, there is shown a winding machine suitable for forming a web material into a coreless roll. Specifically, a winding machine 18 comprises a pair of drive or contact rollers 20, 22 which bear against a substantially cylindrical mandrel 26, as shown in FIG. 4. A web material P is supplied from a supply roll 27 and wound into a roll about the mandrel 26 to a predetermined thickness. To initiate winding of the roll, a pressure roller 28 is lowered to press the leading end of the web material P against the mandrel 26.

A double-acting piston and cylinder assembly 30 is provided above the contact rollers 20, 22 and includes a piston rod 32. The pressure roller 28 is rotatably mounted to the lower end of the piston rod 32. The roller 28 is lifted as the roll increases in diameter.

After a predetermined length of the web material has been wound onto the mandrel 26 to form a roll R, a push rod 35 is extended from a pusher 36 so as to move the roll R to the left in FIG. 2 and onto a pair of receiving rollers 38, 38. The pressure roller 28 is then lifted (as shown in FIG. 3) to allow for the placement of a new mandrel between the contact rollers 20, 22. Thereafter, a cutter 40, in the form of a moveable blade or other severing mechanism, is actuated to sever the roll from the remainder of the web material. As shown in FIGS. 3 and 4, the free or leading end of the continuous web material from the supply roll 27 is rolled onto the new mandrel by means of an air nozzle 42. The pressure roller 28 is again lowered to press the free end of the web material against the mandrel for initial winding of the roll. This mode of operation of the machine is well known in the art.

According to one embodiment of the present invention, the mandrel 26 has a gear-shaped cross section and includes a plurality of axially extending projections **26*a*. These projections 26*a*** preferably have a width of approximately 2.0 mm, and are spaced approximately 3.0 mm from each other. Each roll R preferably has a diameter of approximately 110 mm, and has a hollow axial bore of about 30 to 35 mm in diameter.

An affixing means or binder is applied to at least first two windings of the roll and, preferably, the first six to ten windings, to affix them together, yet allow their release or separation.

Figure 5:
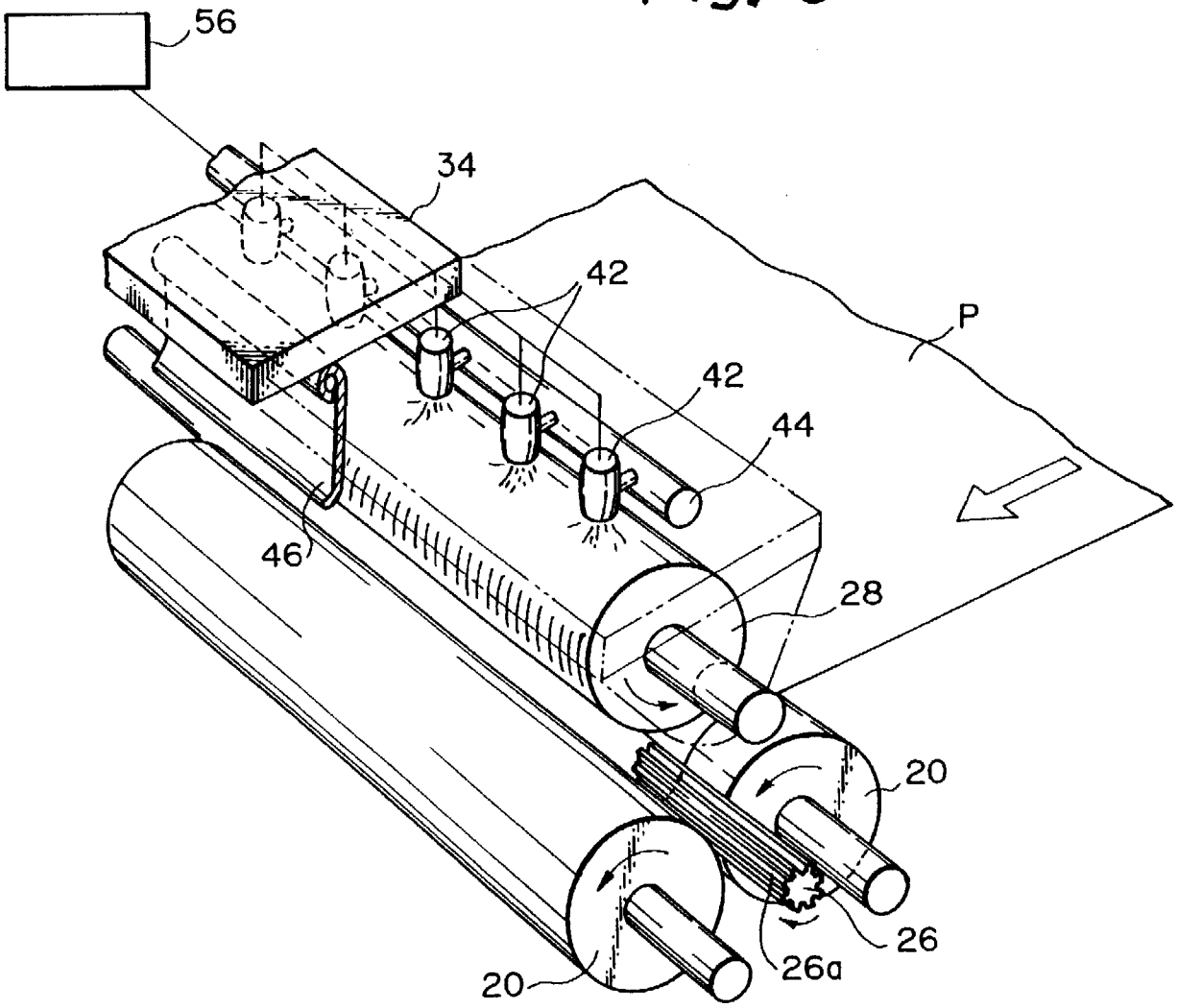
FIG. 5 is a perspective view showing the manner in which affixing binder is evenly distributed on the pressure roller by a blade.

Referring specifically to FIG. 5, a plurality of spray nozzles 42 are arranged, at spaced intervals, above the pressure roller 28 and connected to a feed water line 44. The feed water line 44 is, in turn, mounted to the bracket 34 and connected to a source 56 of water. A blade 46 is pivotally attached to the bracket 34 and allowed to swing and be urged against the pressure roller 28 under the influence of a spring (not shown). Water as an affixing means or binder is supplied from the water source 56 and applied to the surface of the pressure roller 28 through the spray nozzles 42. The water is evenly distributed on the pressure roller 28 by means of the blade 46. As the web material is pressed between the pressure roller 28 and the radially extending projections **26*a* of the mandrel 26, the water is transferred from the pressure roller 28** to the web material to wet at least the first two windings of the roll. As a result of the point contact between the pressure roll and the extending projection, adhesion of the wet windings occurs along continuous lines extending across the width of the roll.

Figure 7:
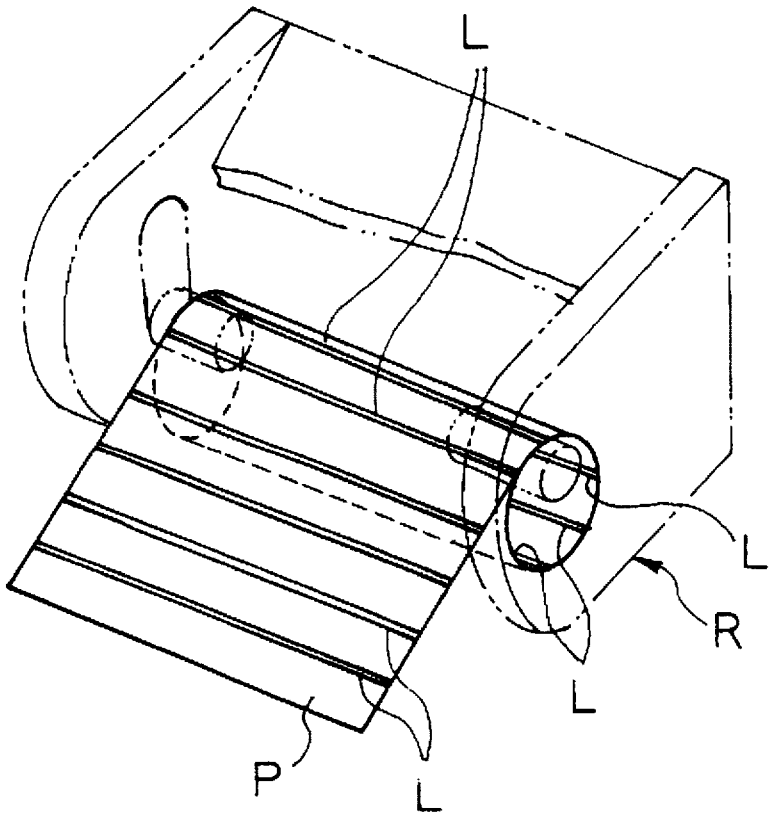
FIG. 7 is a perspective view of a coreless roll of toilet paper of the present invention which has almost been exhausted.

The water serves to loosen the arrangement of fibers of the web material while the fibers are interwound under the pressure of the pressure roller 28. As the water is dried, the interwound fibers firmly affix these first two windings together. The first two windings of the roll can, of course, be released or separated when the web material is pulled. Preferably, a plurality of lines L of adhesion are provided on the first six to ten windings of a roll and extend in parallel to each other at spaced intervals, as shown in FIG. 7. The discrete lines of adhesion allow separation of the initial windings which receive the adhesive. While the lines L are shown extending continuously across one width of the roll and being coextensive with one another, the adhesive may be applied along portions of the width or in discrete points. The space between the lines L represents the interval between projections **26*a*, while the width of lines L represents the width of the projections 26A**. The lines extend transversely, that is, in a direction parallel to the axis of the roll.

Figure 6:
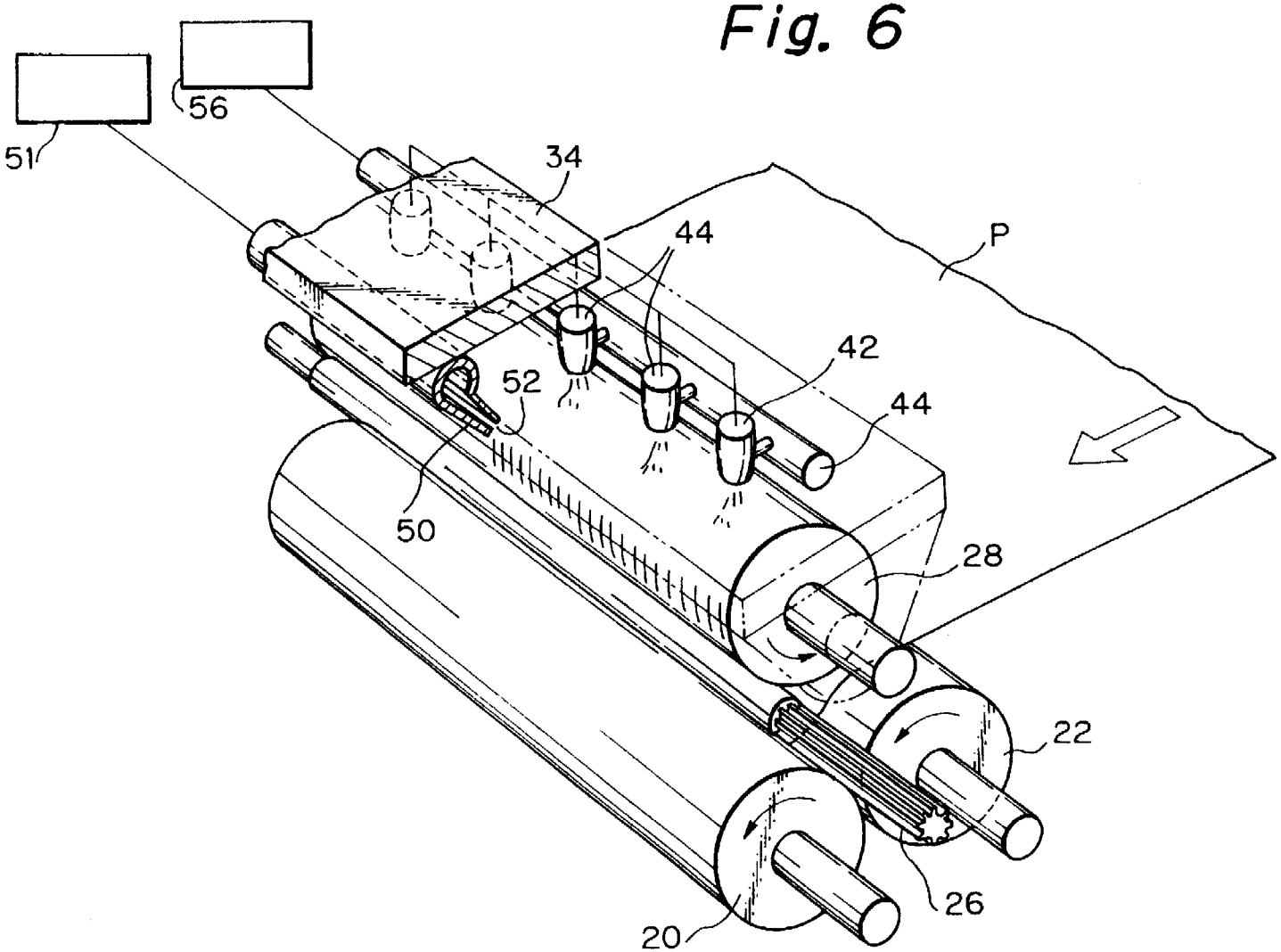
FIG. 6 is a view similar to FIG. 5, but showing the manner in which affixing binder is evenly distributed on the pressure roller by an air nozzle.

As shown in FIG. 6, an air nozzle 50 may alternatively be used to evenly distribute the affixing means on the pressure roller 28. The air nozzle 50 extends along the pressure roller 28 and is connected to a source 51 of pressurized air. The air nozzle 50 has an opening 52 through which air under pressure is directed to the pressure roller 28. The affixing means may alternatively include glue. The glue is preferably diluted about ten to twenty times by means of a suitable diluent such as water. The binder or affixing means must be sufficient to prevent collapsing of the roll. A winding is defined as one complete revolution of the mandrel.

Although the present invention has been described with respect to particular embodiments thereof, it will be readily understood that various modifications and changes may be made without departing from the spirit or scope of the invention.

What is claimed is:

1. A coreless roll of toilet tissue material comprising a plurality of windings with a central bore, at least the first two of said windings adjacent to said central bore including a plurality of circumferentially spaced discrete lines of adhesion along which said at least first two windings are affixed to one another and areas of non-adhesion between said spaced lines of adhesion, said lines of adhesion and areas of non-adhesion extending in a direction substantially parallel to the axis of said central bore of the toilet tissue material, whereby said lines of adhesion and areas of non-adhesion facilitate separation of said affixed windings and permit the use of the roll without collapse of the roll.

2. The coreless roll of claim 1, wherein the coreless roll has a diameter of approximately 110 mm, and said central bore has a diameter of approximately 30 mm.

3. The coreless roll of claim 1, wherein said plurality of discrete lines of adhesion extend substantially across the width of the roll.

4. The coreless roll of claim 1, wherein said discrete lines of adhesion are formed by applying water to said at least first two windings and compressing them along said lines.

5. The coreless roll of claim 1, wherein said discrete lines of adhesion are formed by applying a glue-based solution to said at least first two windings and compressing them along said lines.

6. The coreless roll of claim 1, wherein said plurality of discrete lines of adhesion are substantially parallel and coextensive with one another.

7. A coreless roll of toilet tissue material comprising a plurality of windings with a central bore, at least the first two of said windings adjacent to said central bore including a plurality of circumferentially spaced lines of adhesion along which said at least first two windings are affixed to one another and areas of non-adhesion between said spaced lines, said lines of adhesion extending in a direction substantially parallel to the axis of said central bore of the toilet tissue material and said areas of non-adhesion extending substantially across the entire width of the roll, whereby said lines of adhesion and areas of non-adhesion facilitate separation of said affixed windings and permit the use of the roll without collapse of the roll.

8. The coreless roll of claim 7, wherein the coreless roll has a diameter of approximately 110 mm, and said central bore has a diameter of approximately 30 mm.

9. The coreless roll of claim 7, wherein said plurality of lines of adhesion extend substantially across the width of the roll.

10. The coreless roll of claim 7, wherein said lines of adhesion are formed by applying water to said at least first two windings and compressing them along said lines.

11. The coreless roll of claim 7, wherein said lines of adhesion are formed by applying a glue-based solution to said at least first two windings and compressing them along said lines.

12. The coreless roll of claim 7, wherein said plurality of lines of adhesion are substantially parallel and coextensive with one another.

13. A coreless roll of toilet tissue material comprising a plurality of windings with a central bore, at least the first two of said windings adjacent to said central bore including a plurality of circumferentially spaced lines of adhesion for affixing said at least first two windings to one another and an area of non-adhesion between adjacent two of said spaced lines of adhesion for facilitating separation of said affixed windings and permitting the use of the roll without collapse of the roll, said lines of adhesion and areas of non-adhesion extending in a direction substantially parallel to the axis of said central bore of the toilet tissue material.

14. The coreless roll of claim 13, wherein the coreless roll has a diameter of approximately 110 mm, and said central bore has a diameter of approximately 30 mm.

15. The coreless roll of claim 13, wherein said plurality of lines of adhesion extend substantially across the width of the roll.

16. The coreless roll of claim 13, wherein said area of non-adhesion extends substantially across the entire width of the roll.

17. The coreless roll of claim 13, wherein said lines of adhesion are formed by applying water to said at least first two windings and compressing them along said lines.

18. The coreless roll of claim 13, wherein said lines of adhesion are formed by applying a glue-based solution to said at least first two windings and compressing them along said lines.

19. The coreless roll of claim 13, wherein said plurality of lines of adhesion are substantially parallel and coextensive with one another.

* * * * *